United States Patent [19]

Davies

[11] 4,109,378

[45] Aug. 29, 1978

[54] METHOD OF MAKING AN ELECTRICAL CONNECTOR

[75] Inventor: Dennis Davies, Marple, England

[73] Assignee: International Computers Limited, London, England

[21] Appl. No.: 793,337

[22] Filed: May 3, 1977

[30] Foreign Application Priority Data

May 15, 1976 [GB] United Kingdom ..... 20148/76

[51] Int. Cl.[2] ..... H01R 43/00

[52] U.S. Cl. ..... 29/629; 29/630 B; 29/630 C; 264/267; 339/17 M; 339/17 LM; 339/61 M

[58] Field of Search ..... 29/629, 630 B, 630 C; 339/17 M, 17 LM, 59 M, 61 M, 61 R; 264/267, 268

[56] References Cited

U.S. PATENT DOCUMENTS

| | | | |
|---|---|---|---|
| 3,638,163 | 1/1972 | Loosme | 339/59 M X |
| 3,858,958 | 1/1975 | Davies | 339/17 LM |
| 3,985,413 | 10/1976 | Evans | 339/17 LM |

*Primary Examiner*—Carl E. Hall

*Attorney, Agent, or Firm*—George R. Douglas, Jr.; Sherman Levy

[57] ABSTRACT

A method of making flexible radially compressible tubular electrical connectors involving producing a hollow elastomeric core in a tube of precise dimensions, and then removing circumferential strips of the tube to leave separated conductive rings and strips which provide the electrical connector elements of the connector.

5 Claims, 4 Drawing Figures

METHOD OF MAKING AN ELECTRICAL CONNECTOR

BACKGROUND OF THE INVENTION

1. Field of the Invention

This invention relates to electrical connectors and to methods for making such connectors.

2. The Prior Art

In our U.S. Pat. No. 3,858,958 we have disclosed electrical connectors and methods of making the connectors, which are suitable for interconnecting printed circuit boards, and which connectors include an elongate core of elastomeric material having a substantially constant cross-section; a plurality of thin flexible conductive members arranged in spaced mutually parallel formation along the core; each substantially perpendicular to the longitudinal axis thereof and extending at least partially around the core; and means for securing the conductive members upon the core.

The U.S. Pat. No. 3,858,958 also discloses a method of making such a conductor which includes the stages of forming a plurality of flexible thin-walled electrically conductive rings at spaced positions along and secured to a solid core of elastomeric material of constant cross-section. It is proposed to form the rings by etching them from a hollow cylinder into which the core has been introduced and previously bonded. The cylinder itself is produced by etching the interior wall of metallic tube initially having a wall thickness which is greater than the required wall thickness for the cylinder.

It has been found that the formation of such a connector involves an inherent possibility if not obtaining a sufficiently satisfactory bonding between the outermost surface of the core forming material and the metallic conductors. In addition, the etching of the tube interior was found to involve difficulties in respect of obtaining a high degree of uniformity, i.e. a true cylindrical inner surface.

In a further known proposal, namely in U.S. Pat. No. 3,638,163 it has been proposed to provide a resilient tube which can be Teflon or rubber. Electric conductors are provided on the tube surface by a printing operation. For example, etched foil contacts such as gold plated copper. This known form of connector involves the inherent difficulty of ensuring that the contacts are of uniform radial thickness over their whole length and also of ensuring that the overall width of the various contacts radially of the core is uniform. These difficulties stem from the fact that in the known system one is using as the reference surface (for what is a relatively difficult coating or plating process) a flexible radially compressible substrate which in the first place is not particularly suitable for a precision construction and secondly not particularly suitable for obtaining a permanent bond.

It has been found that the above discussed forms of connectors can be improved by modifying the method of producing the core.

SUMMARY OF THE INVENTION

According to the present invention there is provided a method for producing an electrical connector element including a flexible radially compressible core and a plurality of spaced circumscribing connector elements axially spaced along the core the connectors being subjected to radial compressive forces when in use, said process comprising the steps of (a) providing a thin wall tube of predetermined spring characteristics;

(b) introducing a mandrel into the interior of the tube so as to be effectively co-axial with the tube thereby to define an annular space between the tube and the mandrel;

(c) filling said annular space with a material which is curable to provide predetermined compression characteristics;

(d) causing the material to cure in such manner as to enable curing contraction to be radially away from the mandrel;

(e) removing circumferential strips of tube material to leave said spaced elements attached to the core; and (f) removing the mandrel from the core.

BRIEF DESCRIPTION OF THE DRAWINGS

For a better understanding of the invention and to show how to carry the same into effect reference will now be made to the accompanying drawing in which.

DESCRIPTION OF THE PREFERRED EMBODIMENT

Figure 1:
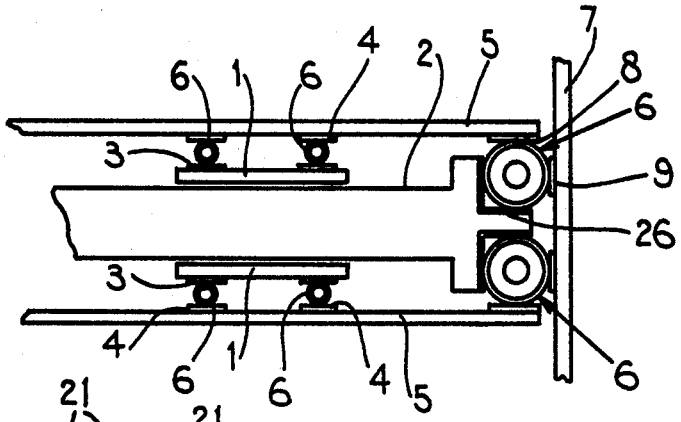
FIG. 1, is a partial sectional view of apparatus embodying connectors produced by the method of the invention.

Referring now to FIG. 1, an arrangement for supporting and interconnecting microcircuits 1 is shown. The microcircuits 1 are mounted on a liquid cooled heat sink 2. Each micro-circuit has a number of contact pads 3 on the surface facing away from the heat sink to provide connections for input and output signals and power supplies. Electrical connections are made from these contact pads to corresponding pads 4 on multi-layer printed circuit boards 5. In addition, the connections between the pads 3 on the micro-circuits and those on the circuit boards 3 are preferably made by further elastomeric connectors 6, constructed in accordance with the present invention.

Since the required interconnection between the pads 3 and 4 is maintained by exerting pressure between the boards 5 and the heat sink 2 the pressure may be released to allow the assembly to be taken apart, repaired and re-assembled. The upper board 5 can provide the connections necessary, to form larger circuit units from the micro-circuits 1 located on the upper face of the heat sink. However, in the case of complex apparatus referred to earlier, it is still necessary to make connections between the upper board 5, the lower board 5 and other similar boards (not shown), as noted above. These additional connections are provided, in the present example, by a vertically arranged printed circuit board 7.

To achieve these connections each board 5 is provided with an additional group of contact pads 8 spaced part along the board edge which is adjacent to the board 7. The board 7 is provided with groups of pads 9 corresponding to the pads 8 of the boards 5. The connection between the pads 8 and the corresponding pads 9 is effected by cylindrical elastomeric connectors 6 constructed by the method of the present invention.

Figure 2:
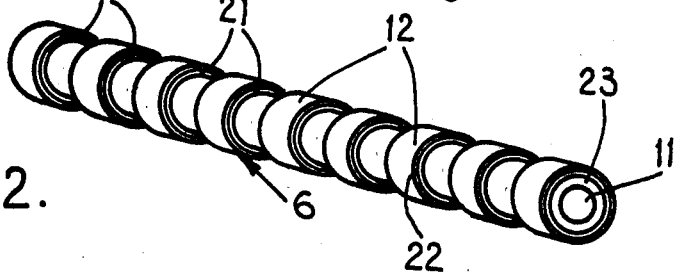
FIG. 2, is a view of a form of the connector produced by the method of the invention.

Each connectors 6 as can be seen from FIG. 2 includes a hollow cylindrical core 10 having a cylindrical bore 11 and is formed of an elastomeric insulating material such as silicone rubber, or polyurethane rubber. The connector 6 also includes a plurality of side by side conductive rings 12.

Figure 3:
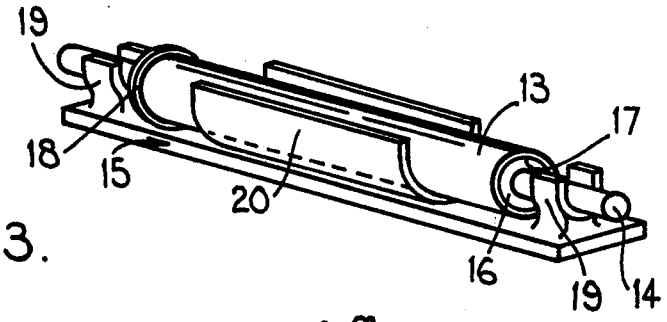
FIG. 3, is a view of a stage in the formation of a connector of FIG. 2.

In forming a connector, by the method of the invention one commences with a length of close tolerance commercially available tubing 13 (FIG. 3). Such tubing is available in a range of alloys including Beryllium Copper and Phosphor Bronze with dimensions in the range 0.003 to 0.625 inches outside diameter with a tolerance variation of ± 10% for the thinnest tube to ± 0.0015 inches for walls thicker than 0.020 inches. By using such a material the spring characteristics are known.

It will be appreciated that other materials, can be used provided they have the required physical and mechanical characteristics.

A cylindrical rod or mandrel 14 is engaged within the tube 13. The mandrel 14 has an external diameter of 0.0625inches when a tube with an outside diameter of 0.125 inches is being used. The combination of the tube and the mandrel are mounted in a moulding jig very schematically shown at 15 so that the tube and mandrel are co-axial: thereby leaving an annular space 16 between the internal surface wall 17 of the tube 13 and the surface of the mandrel 14. The jig 15 provides an end cap 18 to one end of the annular space 16. In addition, the jig effectively provides cradles 19 for the mandrel 14 and a cradle 20 for the tube 13. Polyurethane rubber is injected into the annular cavity. The mandrel 14 is coated with a release agent which is such that the material injected into the cavity does not adhere to the mandrel surface. In the case where the material is polyurethane the release agent is P.T.F.E.. The P.T.F.E. can conveniently be sprayed upon the mandrel. After the injection, the rubber is subjected to a centrifuging operation followed by a curing bake in an oven. It will be understood that the times, and temperatures in the curing operation will be governed by the chemical and physical characteristics of the particular polyurethane rubber being used. In the event that a different material is used to fill the annular space 16, the release agent and the curing parameters will be selected according to the said characteristics of the chosen material. The curing is such that any contraction arising during the curing takes place from the centre i.e. from the mandrel 14 and not from the tube surface 17. That is to say, the curing is such that the material being cured does not pull away from the internal surface 17 of the tube 13. This is important since it has been found in practice that when forming compressible connectors with solid cores the elastomer pulls away from the inner wall of the associated tube so that the subsequently formed rings are loose and thus unsatisfactory as a connector.

After effecting the curing operation, the tube, core, and mandrel are removed from the moulding jig. The mandrel is then removed. At this stage of the method, the resulting product is a precision dimensioned tube, reinforced by a compressible annular core.

To continue with the formation of the connector 6 of the invention it is necessary to remove portions 21 of the tube wall so as to produce the plurality of side-by-side metallic rings 12 each with a required width. In addition, a desired inter-ring spacings will be obtained.

A preferred arrangement for forming the rings 12 is by means of a Gold Plating Resist procedure in which, for example, the gold plating resist is applied by a printing or painting process, or by a dipping process if a photo resist is used.

In a particular arrangement the gold plating resist is printed on the tube at the locations where material is to be removed. The resist is then dried as recommended by the manufacturer.

The still exposed metal of the tube is gold plated. The gold plating resist is then stripped off and the tube is then coated with an etch resist on the gold plated areas by a printing operation. The etch resist is arranged to overlap the edge regions of the gold plated rings 22 on the tube by an amount equal to the wall thickness of the unplated tube. The resist is then dried as recommended by the manufacturer. The tube is then subjected to an etching stage which removes the non-plated regions of the tube. The etchant undercuts the resist but not the gold plating so that the etching operation does not adversely affect the bonding between the gold plating 22 and the core 11. It will be appreciated that the gold plated rings will be only a few microns thick so that they can only be symbolically represented in FIG. 2.

The resist is then stripped off.

It will be understood that since the rings have been formed from the metal tube 13 the rings will have known characteristics in respect of springiness. Furthermore, in view of the firm connection between the rings and the elastomer the rings aid in restoring the elastomeric core to its initial shape after removal of pressure.

Another method is to use a positive photo resist and following the resist dipping and drying by mounting the tube for rotation in front of a light exposure device, which allows light to be directed upon the tube as it rotates so that the photo resist is exposed to light in the regions where the metal is to be gold plated. This softens the resist in these regions and permits it to be washed away in the developing process which follows.

The exposed metal of the tube is gold plated. The resist is then stripped off. The process of photo resist coating and exposure is then repeated but this time exposing the unplated regions allowing a plating overlap as in the previous method, so that the photo resist in these areas will be softened and removed in the developing process. The following etch process will remove the unplated metal.

The resist is then stripped off.

Following the above procedure, the resulting assembly will comprise the annular elastomeric core 23 carrying a plurality of the side-by-side spaced apart rings 12. This assembly thus forms the connector of the invention.

Figure 4:
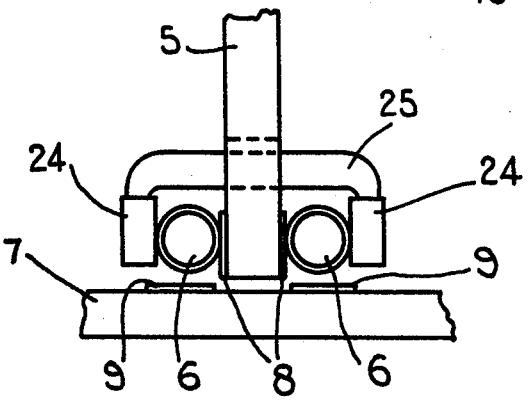
FIG. 4, is a view partly in section of a second way in which connectors of the invention can be used.

A further application of the connectors of the invention is shown in FIG. 4 in which the connectors are used to provide connections between individual printed circuit boards, such as 5, and a mother board, such as 7, in those cases where a heat sink of the kink shown in FIG. 1 is not required. In this case a pair of connectors 6, one on either side of a board 5, are each held between the board 5 and a case structure including case sides 21 which extend the full length of the boards 5 and 7. The sides 24 are connected at intervals by bridge pieces 25 041096033 which can slide, vertically as shown in the drawing, in slots in the board 5. The bridge pieces provide spacers between the sides 24 which effectively provide compartments in which the connectors 6 are axially located, relative to the boards 5 and 7. The bridge pieces 25 are moved in a direction away from the board 7, carrying the case sides 24 with them. This movement of the case sides 24 rolls the connectors 6 clear of the board 7 to permit the withdrawal of the board 5 from the board 7. When the board 5 has been replaced in position the bridge pieces 25 are moved towards the board 7, rolling the connectors in a downward direction as shown in the drawing, into contact with the pads 9. In practice, the case sides 21 are spaced apart by a distance which compresses the rings of the connectors 6 slightly to provide the required contact pressure to the pads 8 of the board 5. The bridge pieces 25 are, in practice, latched in their operated position to maintain the connectors 6 with sufficient contact pressure on the pads 9.

In all the arrangements described above, it will be seen that the inter-board circuit connections are provided by connectors 6 which consist essentially of a number of thin-walled conductive rings spaced apart along a common hollow elastomeric core. The rings are sufficiently thin to be flexible, thus ensuring that they may be so distorted that all of them make good electrical contact with pads on the boards. The hollow elastomeric core is chosen to provide sufficient support to the rings so that adequate contact pressures may be maintained. It has been found that because the polyurethane rubber has hysteresis the ring spring must be capable of returning the contact to its original round shape when the contact pressure is removed or ensure continuous contact when the contact pressure fluctuates. The ring design is a compromise between being sufficiently stiff to give good spring characteristics and low electrical resistance, and being just sufficiently thin to be able to deflect without permanent distortion in satisfying production manufacturing tolerances of all the components concerned.

The connector may be rectangular, or oval, in cross section, for example, instead of circular. The rings forming the conductive areas 12 may actually be only segments, i.e. the rings may not be quite complete about the circumference of the elastomer core 11, and may extend only as far as is necessary to provide contact with, and a connection between, the pads 8 and 9. This form of construction renders unnecessary the provision of an insulation layer 26. (See FIG. 1) on the heat sink 2 to prevent short circuiting of the rings 12. Alternatively, the layer 26 may be retained and the part of the surface of the elastomer which is not covered by the incomplete rings may be used to carry conductive tracks which link selected segments to provide an additional level of interconnection.

The boards 5 and 7 may be conventional single or double sided printed circuit boards, or they may be multi-layer boards, depending upon the density of interconnection which is required.

I claim:

1. A process for producing an electrical connector element including a flexible radially compressible core and a plurality of spaced circumscribing connector strips axially spaced along the core the connectors being subjected to radial compressive forces when in use, said process comprising the steps of (a) providing a thin wall tube of predetermined spring characteristics; the tube having inner and outer cylindrical surfaces each with close diametrical dimensional tolerances;

(b) introducing a mandrel into the interior of the tube so as to be effectively co-axial with the tube thereby to define an annular space between the inner cylindrical surface of the tube and the mandrel;

(c) filling said annular space with a material which is curable to provide a core of an elastomeric material with predetermined compression characteristics;

(d) causing the material to cure in such manner as to ensure that the material does not adhere to the mandrel but bonds to the tube inner surface during curing whereby any radially directed tension forces produced during curing are relieved by radial contraction of the material away from the mandrel;

(e) removing circumferential strips of tube material to leave said spaced parallel conductive strips bonded to the core; and (f) removing the mandrel from the core.

2. A process as claimed in claim 1, and including the step of covering the tube during said removal of the circumferential strips whereby said parallel conductive strips are covered with electrically conductive material.

3. A process as claimed in claim 2, in which said conductive material covering is formed by a plating operation.

4. A process as claimed in claim 1, in which the tube comprises Beryllium copper 5. A process as claimed in claim 1, in which the tube comprises phosphor bronze.

* * * * *